United States Patent [19]

Ashmore

[11] Patent Number: 4,748,906

[45] Date of Patent: Jun. 7, 1988

[54] AIR SHOWER APPARATUS AND METHOD

[75] Inventor: Gregory J. Ashmore, Lancaster, Ohio

[73] Assignee: AccuRay Corporation, Columbus, Ohio

[21] Appl. No.: 842,479

[22] Filed: Mar. 21, 1986

[51] Int. Cl.[4] ..... B30B 15/34

[52] U.S. Cl. ..... 100/93 RP; 100/47; 100/162 B

[58] Field of Search ..... 100/38, 47, 93 RP, 162 B, 100/168

[56] References Cited

U.S. PATENT DOCUMENTS

| | | | |
|---|---|---|---|
| 737,571 | 9/1903 | Bray | 100/93 RP |
| 2,141,403 | 12/1938 | Offen | 34/54 |
| 2,981,175 | 4/1961 | Goyette | 100/93 RP |
| 3,177,799 | 4/1965 | Justus et al. | 100/93 RP |
| 3,190,212 | 6/1965 | Moore | 100/38 |
| 3,193,377 | 7/1965 | Guseman | 100/93 RP |
| 3,203,678 | 8/1965 | Sawyer et al. | 100/93 RP X |
| 3,266,561 | 8/1966 | Beachler | 100/93 RP X |
| 3,770,578 | 11/1973 | Spurrell | 162/206 |
| 4,114,528 | 9/1978 | Walker | 100/47 |
| 4,573,402 | 3/1986 | Sharma et al. | 100/38 |
| 4,605,366 | 8/1986 | Lehman et al. | 100/93 RP X |
| 4,610,617 | 9/1986 | Christ et al. | 100/93 RP X |
| 4,653,396 | 3/1987 | Wennerberg | 100/38 |
| 4,671,173 | 6/1987 | Boissevain | 100/38 |
| 4,685,389 | 8/1987 | Boissevain | 100/93 RP |

FOREIGN PATENT DOCUMENTS

| | | | |
|---|---|---|---|
| 211003 | 9/1956 | Australia | 100/162 B |

*Primary Examiner*—Wm. Carter Reynolds

*Attorney, Agent, or Firm*—Joseph R. Black

[57] ABSTRACT

A hooded air shower system for controlling the diameter profile of a rotating cylinder. Air is supplied to an air chamber and then channeled into a plurality of conduits that correspond to a plurality of cross-machine zones of the cylinder. The air temperature is regulated within each conduit and separate channeling is maintained until the air is directed to the cylinder. An obstructing device substantially restricts movement of the air along the cylinder to one circumferential direction, and a given portion of directed air moves along substantially the entire circumferential range of the cylinder that is subtended by the hood.

4 Claims, 3 Drawing Sheets

AIR SHOWER APPARATUS AND METHOD

TECHNICAL FIELD OF THE INVENTION

This invention relates to controlling the diameter profile of a rotating cylinder. More particularly, it relates to air shower systems which achieve such control by directing air, at a controlled temperature, toward the surface of the rotating cylinder in each of a plurality of cross-machine zones that extend along the length of the cylinder. Yet more particularly, it relates to such systems which employ hoods to maintain the air in close proximity to the cylinder for a longer period of time in order to increase efficiency of heat transfer.

Such systems are useful in the production of paper, for example, where it is desired to maintain a uniform thickness thereof in the cross-machine direction. As the paper passes through a nip formed by two rotating cylinders, its thickness and its thickness profile can be controlled by controlling the diameter of one cylinder in each of a plurality of cross-machine zones. This may be accomplished in a variety of ways, as by selectively varying the flow rate at which air is directed to the cylinder, selectively varying the temperature of air that is directed at a uniform flow rate, or by selectively directing air toward the cylinder.

Although this invention can be used in a variety of continuous-process applications where the product is subjected to operations which are variously described as calendering, pressing, or rolling, it should be particularly useful in the manufacture of paper products.

BACKGROUND ART

Air shower systems of the above description have been known for many years. In the invention of U.S. Pat. No. 2,981,175 Goyette, hot or cold air is made alternatively available to a plurality of nozzles that extend along a cylinder in the cross-machine direction. The system apparently contemplates manual operation and temperature selection for each nozzle in order to control sheet caliper (thickness) in a papermaking application.

The invention of U.S. Pat. No. 3,177,799 Justus provides for controlling the diameter profile of calender rolls by moving a fluid projector unit to a selected cross-machine region of the calender roll and applying hot or cold fluid to the selected region.

The invention of U.S. Pat. No. 3,203,678 Sawyer provides an automated air shower system wherein a traversing pyrometer scans the roll or cylinder to detect hot spots in four cross-machine zones. Upon detecting temperature above a critical level in any zone the pyrometer, via its internal circuitry, activates a corresponding nozzle to direct corrective air against the roll until it is cooled below the critical temperature level.

The invention of U.S. Pat. No. 3,770,578 Spurrell provides for regulating the temperature of air flowing from each nozzle by mixing hot and cold air just behind each nozzle to desired proportions, and for simultaneously directing air from adjacent nozzles to eliminate edge effects.

The invention of U.S. Pat. No. 4,114,528 Walker provides for directing a uniform flow of air through the nozzles and adjusting the temperature of the air at each nozzle by mixing hot and cold air in a manner similar to Spurrell, above.

In the above inventions, air that is directed toward the roll or cylinder is substantially unconstrained with respect to its escape path away from the cylinder. As a result, there is substantially laminar flow along a relatively small circumferential portion of the cylinder.

In the inventions of U.S. Pat. Nos. 2,141,403 Offen, 3,190,212 Moore, 4,573,402 Sharma, and 3,266,561 Beachler, devices that are variously described as hoods or faceplates serve as a means for preventing the escape of air in directions away from the surface of the cylinder. This improves heat transfer for a given flow rate of air from the nozzles (or other means for directing air toward the cylinder) by extending the time during which the air is in contact with the surface of the cylinder, and by creating conditions under which air between the hood and the cylinder can be maintained in a turbulent state. U.S. Pat. No. 4,573,402 Sharma employs electrical heating elements within an air plenum of which the hood or faceplate is a part, and also discloses the idea of directing air toward the cylinder at an angle whereby the directed air has a component of velocity that is in a direction opposite the direction of rotation of the cylinder.

U.S. Pat. No. 2,141,403 Offen discloses a hooded air shower system that provides two end seals for preventing the escape of air between the hood and a web into the surrounding atmosphere, and provides exhaust openings in the hood as escape routes for the discharged air.

The above inventions that employ hoods have been developed under at least two tacit assumptions from which the instant invention departs.

First, all have the feature that the hood is used as a manifold through which air is directed toward the cylinder. While this feature may be used in an embodiment of the instant invention, this invention recognizes that the feature is unnecessary and may be undesirable because it reduces the available circumferential range of the cylinder over which a given portion of air can travel and over which heat transfer can take place.

Second, all have the feature that when air is directed toward the cylinder, substantial portions thereof are permitted to flow in either direction along the cylinder. This feature is costly because it requires higher flow rates to achieve a given rate of heat transfer than would be required if movement of the air along the cylinder were substantially restricted to one direction.

Further distinguishing features of the invention will be recognized in the drawings and description which follow.

DISCLOSURE OF THE INVENTION

This invention provides apparatus and methods for controlling the diameter profile of a thermally expansible rotating cylinder. The invention comprises elements or methods steps for directing air toward the surface of the cylinder in each of a plurality of cross-machine zones and at a flow rate that is substantially uniform across the plurality of cross-machine zones; preventing, beyond a predetermined distance and along a predetermined circumferential range of the cylinder, escape of the air in directions away from the surface of the cylinder; obstructing movement of the air along the cylinder in a first circumferential direction to substantially restrict movement of the air to a second circumferential direction that is opposite the first; and regulating the temperature of air for each of the cross-machine zones to control the diameter profile of the cylinder.

The air may be directed from a location that is outside the circumferential range defined by the preventing element or step.

The movement of air along the cylinder may be obstructed in one direction at a location that is within 10 degrees of arc, as measured along the circumference of the cylinder, from the location at which air is directed toward the surface of the cylinder.

The location from which the air is directed may be restricted to one circumferential position of the cylinder that is common for all cross-machine zones.

The invention may further comprise an element or step for channeling the air, prior to the time at which its temperature is regulated, into a plurality of separate conduits corresponding to the plurality of cross-machine zones, and for maintaining the separate channeling up to the time at which the air is directed toward the cylinder.

The temperature of the air may be regulated by means of electrical heating coils, and the air may be chilled to a selected control temperature before it is channeled into separate conduits for temperature regulation.

An object of the invention is to provide greater efficiency of heat transfer in air shower systems that employ hoods, by forcing directed air to travel along the cylinder over substantially the entire circumferential range of the cylinder that is subtended by the hood.

Another object of the invention is to provide a hooded air shower system that requires a lower flow rate to achieve a given rate of heat transfer, by forcing directed air to travel in one circumferential direction with respect to the cylinder.

A further object of this invention is to provide greater control over the temperature of air that is directed toward the cylinder in any given cross-machine zone, by channeling the air into separate conduits corresponding to each cross-machine zone prior to regulating the temperature at which the air will be directed, and by maintaining this separate channeling until the air is directed toward the cylinder.

These and further objects are provided by the invention, which is more fully described below.

BEST MODE OF CARRYING OUT THE INVENTION

Figure 1:
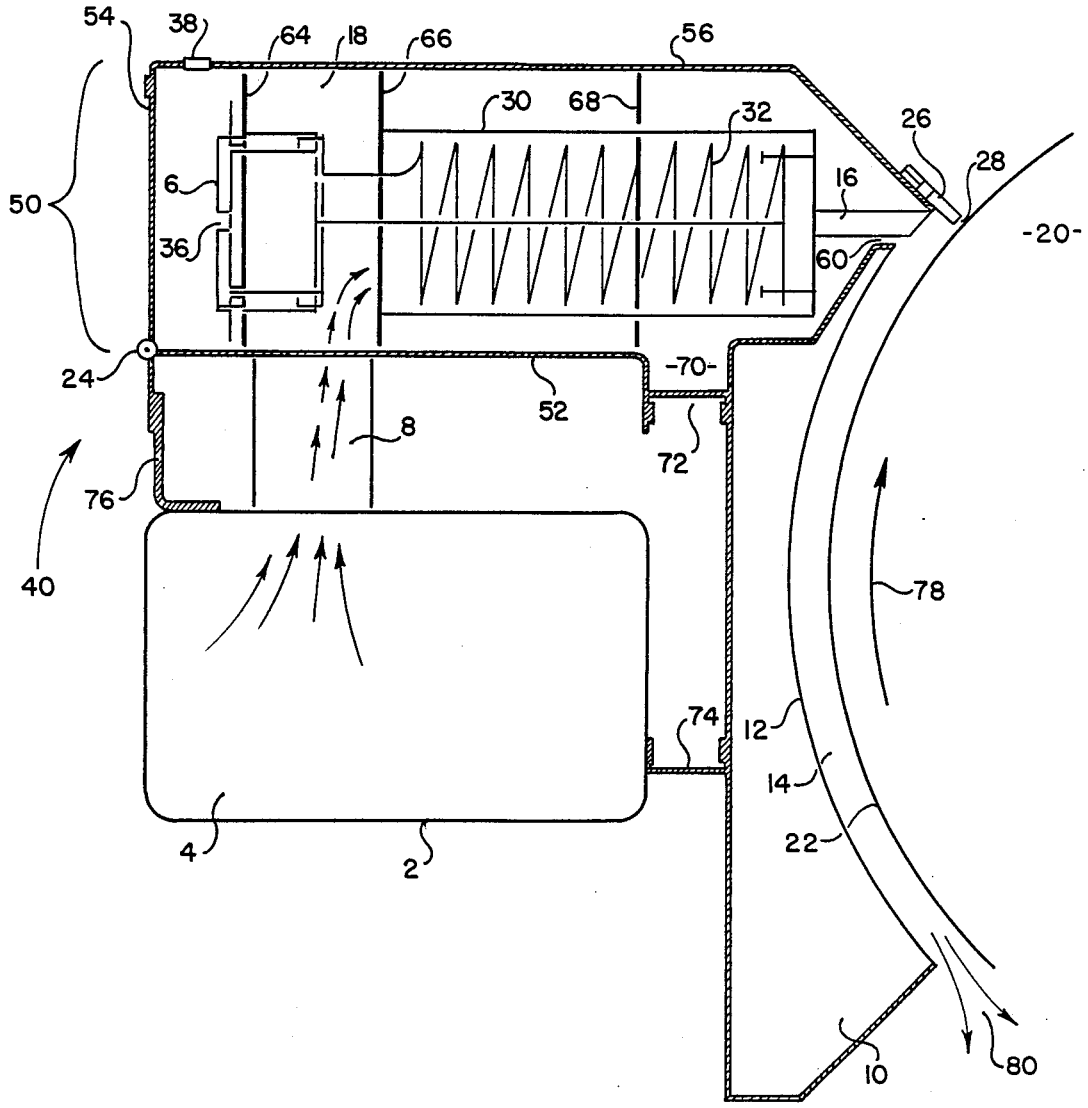
FIG. 1 is a cross-sectional and partially schematic view of an embodiment of the invention.

Referring to FIG. 1 of the drawings, the numeral 40 designates an air shower system for controlling the diameter profile of a thermally expansible, rotating cylinder 20. Components of the air shower system 40 include a heating section 50, a plenum housing 2, standpipes 8 between the heating section and the plenum housing, a hood 10, and brackets 72, 74, and 76.

An obstructing device 26 is mounted on the top plate 56 of the heating section 50, and extends toward the cylinder 20 to define a clearance 28 between the obstructing device and the surface 22 of the cylinder.

The front surface 12 of the hood 10 is contoured in accordance with the surface 22 of the cylinder 20. The clearance between the front surface 12 and the surface 22 of the cylinder defines an air duct 14. The hood 10 will vary in size according to the application, but will ordinarily cover no more than a ninety-degree circumferential portion of the cylinder 20, and may cover a lesser portion in order to avoid interference with other components of the process to which the air shower system 40 is applied.

Figure 2:
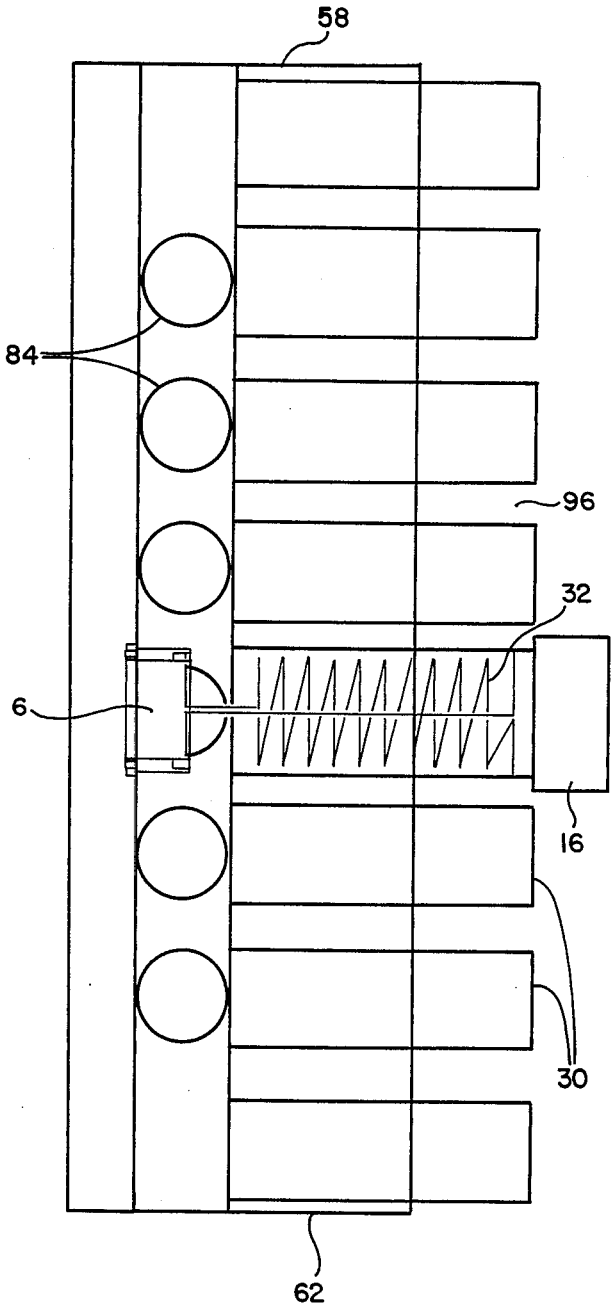
FIG. 2 is a top view which illustrates certain features of the embodiment of FIG. 1.

The heating section 50 has outer structural members comprising a top plate 56, a bottom plate 52, two side plates 58 and 62 as shown in FIG. 2, and a rear plate 54 which is pivotally attached to the bottom plate by a hinge 24 for access to the interior. The heating section 50 also has inner structural members comprising first, second, and third bulkheads 64, 66, and 68, respectively. Second and third bulkheads 66 and 68 also support a plurality of conduits 30 and for that reason these bulkheads have a corresponding plurality of openings (not shown) through which the conduits can pass.

The first bulkhead 64 also has a plurality of openings (not shown) through which a plurality of first bulkhead assemblies 6 are fitted in airtight fashion. Airtight seals (not shown) are placed between each conduit 30 and each corresponding opening of both the second bulkhead 66 and the third bulkhead 68. The first, second, and third bulkheads 64, 66, and 68 are welded to the top plate 56, the bottom plate 52, and side plates 58 and 62. Thus, air cannot leave the air supply chamber 18 and pass to any other region of the heating section 50 unless it is channeled through the conduits 30.

Each of the conduits 30 houses means for regulating the temperature of air that is channeled through it. (For illustration, this is shown for only one conduit in FIG. 2.). The temperature regulating means 32 may include heating rods, electrical heating coils, or any functionally similar temperature regulating means that can be adapted to the invention (electrical heating coils are shown). The temperature regulating means 32 are in electrical communication with a remote process controller 92 (shown in FIG. 3), and for this purpose a first passage 36 and a second passage 38 are provided in the first bulkhead assembly 6 and top plate 56, respectively.

A plurality of nozzles 16 or similar means for directing air toward the surface 22 of the cylinder 20 are fitted to the plurality of conduits 30 in airtight fashion. Each nozzle is associated with a particular cross-machine zone of the cylinder 20.

The air shower system 40 is designed in modular form so that an entire module covers eight cross-machine zones, as is best seen in FIG. 2. These are joined so that the entire system extends over the entire length of the cylinder 20, or over so much of the cylinder as is required for a particular application. The cross-machine width of the nozzles 16 is on the order of $3\frac{3}{4}$ inches, and it is desirable that these be placed as closely together as possible so that the entire diameter profile of the cylinder 20 can be controlled. Conversely, it is desirable that there be come separation between conduits 30, as shown at 96 in FIG. 2, so that heat exchange between conduits is minimized. Therefore, in the embodiment illustrated in FIG. 2, the nozzles 16 are wider than the conduits 30.

The bottom plate 52 has openings 84 as are shown in FIG. 2 and into which standpipes 8 are fitted. There are corresponding openings (not shown) in the plenum housing 2. The standpipes 8 are welded to both the bottom plate 52 and the plenum housing 2.

Although brackets 72, 74, and 76 are used to join components of the system, any suitable means can be employed to this end. However, it should be noted that if the clearance 60 between the nozzles and the hood is too large, it will become desirable to ensure that bracket 72 forms an airtight seal along the entire length of the hood 10 and the bototm plate 52, and that the side plates 58 and 62 be extended to form airtight seals along the top plate 56, the hood 10, and the bracket 72. This will create a pressurized chamber 70 so that performance of the system will not be adversely affected by air loss through the clearance 60. In the current design, this clearance is approximately 1/16 inch and has no significant impact on system performance.

The obstructing device 26 extends across the entire length of the top plate 56. Alternatively, the top plate 56 may be extended so that it serves as the obstructing device. In the embodiment shown in FIG. 1, the device comprises a Teflon strip that is spring loaded so that incidental contact with the cylinder 20 does not result in damage to its surface 22.

An important object of the invention is to restrict movement of the air to one direction along the cylinder 20. Accordingly, the clearance 28 between the obstructing device 26 and the cylinder 20 should be as small as possible, but large enough to avoid contact due to either eccentricity of the cylinder or cross-machine variations in its diameter.

The obstructing device 26 could be located farther from the nozzles 16 than is shown in FIG. 1. For example, air could be directed to the cylinder 20 through the hood 10 at some desired circumferential location, or the obstructing device 26 could simply be positioned farther from the nozzles 16 with the nozzles remaining in the location that is shown. While this may prove necessary in a particular application, it is generally to be avoided because efficiency of heat transfer will decrease with increasing separation of the obstructing device 26 from the nozzles or directing means 16.

Regarding materials, stainless steel was chosen for most components because of its strength, appearance, and resistace to corrosion. Teflon was chosen for the obstructing device 26 for reasons explained above. The chosen temperature regulating means 32 are electrical resistance heating coils comprising a nickel-chromium wire with a stainless steel outer sheath, which may be obtained from Watlow Electric Manufacturing Co. However, any functionally-equivalent materials that are suitable for the process and environment to which the invention is applied may be used in accordance with the invention.

In the operation of the air shower system 40, air is delivered at a uniform flow rate from a remote source 42 to the plenum 4. The flow rate must be sufficiently high to ensure that air passes from the plenum 4 into the standpipes 8 at a flow rate that is substantially uniform across all standpipes. The air passes through the standpipes 8, into the air supply chamber 18, and is channeled into the conduits 30 where it is treated by temperature regulating means 32 that are contained in the conduits and that are controlled by a remote process control unit 96. The air then enters nozzles or other directing means 16 from which it is directed toward the surface 22 of the cylinder 20.

Obstructing means 26 are employed to obstruct movement of the air along the cylinder 20 in the direction of rotation of the latter (as shown at 78), thereby substantially restricting movement along the cylinder to the opposite direction. A hood 10 or similar device serves to prevent, beyond a predetermined distance that is limited by the front surface 12 of the hood and along a predetermined circumferential range of the cylinder 20 that is defined by the portion of the circumference of the cylinder that is subtended by the front surface of the hood, escape of the air in directions away from the cylinder. The air therefore moves along an air duct 14 between the hood 10 and the cylinder 20 and, in moving along the entire circumferential range defined by the front surface 12, maximizes the time during which heat transfer can occur. The air then escapes into the surrounding atmosphere, as shown at 80.

Air that is moving along the air duct 14 will transfer or absorb heat more efficiently if its flow is turbulent rather than laminar. Therefore, the flow rate from the remote source 42 should be sufficiently high to induce turbulent flow in the air duct 14. It will be recognized that the flow rate which is required will depend on the width of the air duct 14 and the clearance 28 between the obstructing device 26 and the cylinder 20. Within limits, turbulence can always be produced by a suitable flow rate adjustment. In the current design, the width of the air duct 14 is approximately ½ inch, the clearance 28 is approximately ⅛ inch, and there is no difficulty in producing turbulent air in the air duct.

Although it is desirable for the air to travel along the entire length of the air duct 14 in order to maximize the time during which a particular portion of air can contribute to the heat transfer process, it should be recognized that the efficiency with which that particular portion can contribute decreases over time. Therefore, keeping the same portion of air within the air duct 14 is not to be preferred over directing a more recent, and consequently a more thermally efficient, portion of air into the air duct. For this reason, it is considered preferable to have only one row of nozzles 16 or other directing means rather than two or more rows which work against each other to produce slow or stagnant air within the air duct 14.

Figure 3:
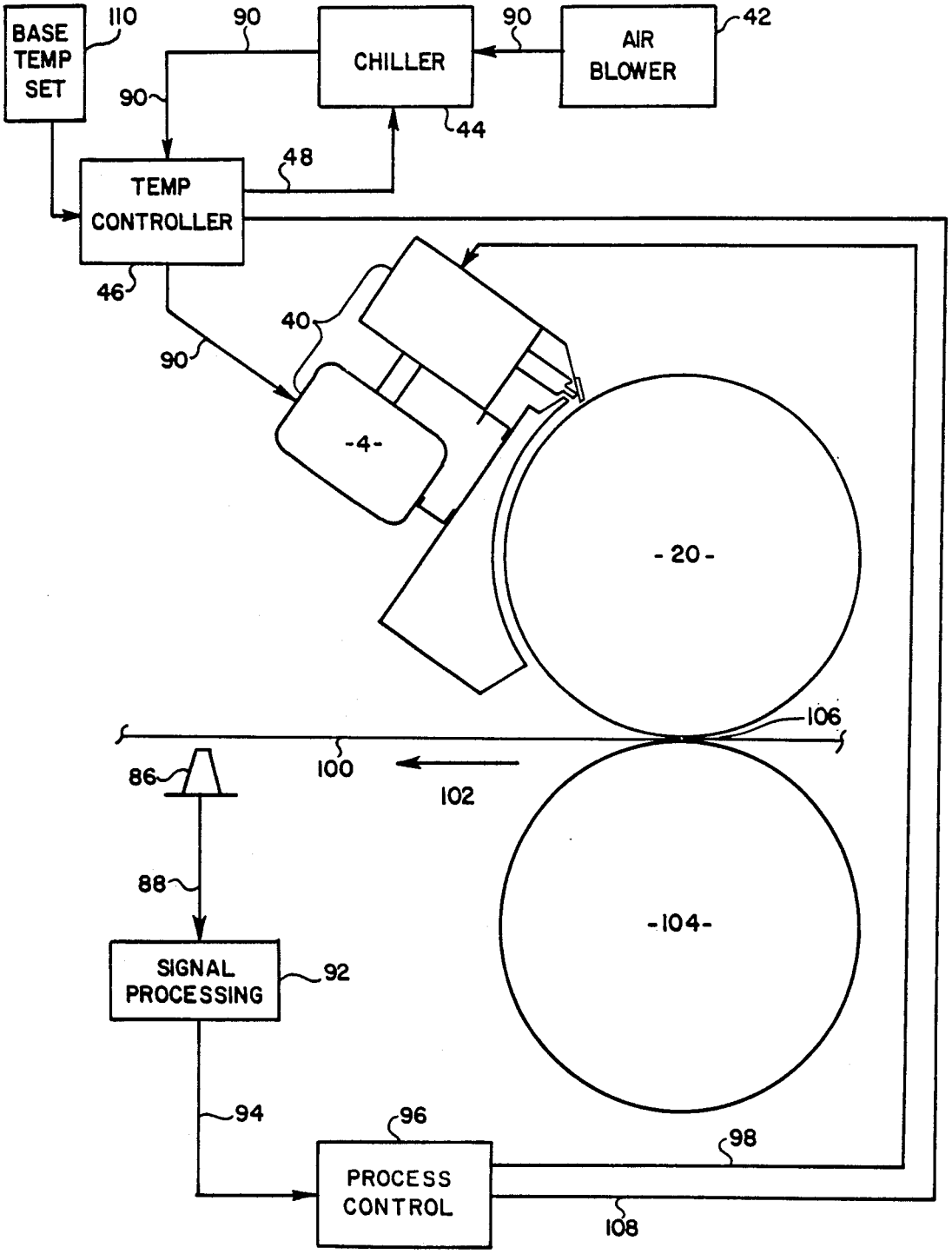
FIG. 3 is a schematic illustration of a further embodiment of the invention.

In FIG. 3 of the drawings, the numeral 90 designates air flow. This schematically illustrated embodiment provides for controlling the temperature of directed air over a greater thermal range than is available in a system which does not thermally treat the air between its source and the air shower system to which it is delivered. Therefore, it provides faster response when reductions in the diameter of the cylinder are required.

The numeral 100 designates a web that travels in the direction indicated at 102 and passes through a nip 106 formed between the treated cylinder 20 and a second cylinder 104. A sensor 86 is mounted on a conventional traversing mechanism (not shown) and moves back and forth over the web 100 in a direction that can be viewed as extending into and out from the drawing. The sensor 86 is used to measure a physical parameter of the web 100 that is affected by the pressure exerted at the nip 106. Caliper and smoothness are examples of such parameters. The sensor 86 provides analog responses 88 to a signal processing unit 92. The signal processing unit 92 is in communication with a process control unit 96, as indicated at 94. The process control unit communicates with the air shower system 40, as indicated at 98, to control each of the temperature regulating means 32 (FIG. 1).

An air blower 42 delivers air to the air plenum 4 through a chiller 44. The air temperature between the chiller 44 and the air plenum 4 is monitored by a temperature controller 46. A desired base temperature is set within the temperature controller 46 as indicated at 110.

The temperature controller 46 controls operation of the chiller 44 as indicated at 48 to correct for deviations from the base temperature. The process control unit 96 may send a signal 108 to the temperature controller 46 to temporarily override the base temperature setting 110 and allow colder air to be delivered to the air plenum 4 when a more rapid reduction in the diameter of the cylinder 20 is required at any cross-machine zone.

While the invention has been set forth according to particular features and procedures which describe preferred embodiments, the description herein is intended to be illustrative and not restrictive. It will be recognized that many modifications to the invention can be made without departing from its spirit and scope.

What is claimed is:

1. An apparatus for controlling the diameter profile of a thermally expansible rotating cylinder, comprising:

(a) a hood for preventing, beyond a predetermined distance and along a predetermined circumferential range of the cylinder, escape of air in directions away from the surface of the cylinder;

(b) means, located outside the circumferential range defined by the hood, for directing air toward the surface of the cylinder in each of a plurality of cross-machine zones and at a flow rate which is substantially uniform across the plurality of cross-machine zones, wherein the location of the directing means corresponds to a single circumferential position respecting the cylinder, the position being common for all cross-machine zones;

(c) means for obstructing movement of the air along the cylinder in a first circumferential direction, to substantially restrict movement of the air to a second circumferential direction that is opposite the first;

(d) means including electrical heating coils for regulating the temperature of air for each of the cross-machine zones to control the diameter profile of the cylinder; and (e) means for channeling the air, prior to its arrival at the electrical heating coils, into a plurality of separate conduits corresponding to the plurality of cross-machine zones, and for maintaining the separate channeling through the heating coils and up to the directing means.

2. An apparatus as in claim 1 further comprising means for chilling the air to a selected temperature prior to its arrival at the channeling means.

3. An apparatus for controlling the diameter profile of a thermally expansible rotating cylinder, comprising:

(a) a heating section containing a plurality of separate conduits into which air delivered from a remote source is channeled;

(b) a hood, joined to the heating section, for preventing, beyond a predetermined distance and along a predetermined circumferential range of the cylinder, escape of air in directions away from the cylinder;

(c) a plurality of nozzles corresponding to the plurality of separate conduits and being fixed thereto for directing air channelled into and through the conduits toward the surface of the cylinder in each of a plurality of cross-machine zones and at a flow rate which is substantially uniform across the cross-machine zones, the nozzles being arranged in only one row at a common circumferential position respecting the cylinder, being located outside the circumferential range defined by the hood, and having cross-machine widths that exceed cross-machine widths of the conduits so that adjacent nozzles may be closely spaced while maintaining separateness of the conduits; and (d) a plurality of heating coils contained within the plurality of conduits for regulating in each cross-machine zone the temperature of air directed toward the surface of the cylinder, wherein a portion of the heating section extends beyond the plurality of nozzles, effecting a small clearance between the portion and the cylinder to obstruct movement of the air along the cylinder in a first circumferential direction and substantially restrict movement of the air to a second circumferential direction that is opposite the first.

4. An apparatus as in claim 3 further comprising means for chilling the air to a selected temperature prior to its arrival at the conduits.

* * * * *